US005321481A

United States Patent [19]

Mathers

[11] Patent Number: 5,321,481

[45] Date of Patent: Jun. 14, 1994

[54] FUSER TEMPERATURE AND COPY OUTPUT CONTROLLER

[76] Inventor: James E. Mathers, 126 Creek Hill La., Rochester, N.Y. 14625

[21] Appl. No.: 935,795

[22] Filed: Aug. 27, 1992

[51] Int. Cl.[5] ..... G03G 15/20

[52] U.S. Cl. ..... 355/290; 355/208; 355/282; 355/285

[58] Field of Search ..... 355/203, 204, 205, 206, 355/207, 208, 282, 285, 290, 77

[56] References Cited

U.S. PATENT DOCUMENTS

| | | | |
|---|---|---|---|
| 4,480,908 | 11/1984 | Anzai | 355/285 |
| 4,618,247 | 10/1986 | Tsuji | 355/208 |
| 4,671,643 | 6/1987 | Shigemura et al. | 355/282 |
| 4,977,431 | 12/1990 | Fuji | 355/290 X |
| 5,040,022 | 8/1991 | Kinoshita et al. | 355/206 |
| 5,051,780 | 9/1991 | Stelter et al. | 355/208 |
| 5,073,799 | 12/1991 | Watanabe | 355/285 |
| 5,081,493 | 1/1992 | Miyasaka | 355/208 |
| 5,111,249 | 5/1992 | Owada | 355/285 |
| 5,170,215 | 12/1992 | Pfeuffer | 355/285 |
| 5,191,375 | 3/1993 | Hamilton | 355/205 |

FOREIGN PATENT DOCUMENTS

| | | | |
|---|---|---|---|
| 3917773 | 12/1989 | Fed. Rep. of Germany | 355/290 |
| 0086574 | 5/1985 | Japan | 355/290 |

*Primary Examiner*—A. T. Grimley
*Assistant Examiner*—Sandra L. Brasé
*Attorney, Agent, or Firm*—Oliff & Berridge

[57] ABSTRACT

An electrophotographic copy machine includes a system manager which controls the operation of the copy machine based on a plurality of performance levels corresponding to fuser copy quality characteristics, i.e., TPE, gloss and fuse fix. Each performance level corresponds to job parameters of a job to be performed, such as black and white paper copies, black and white copies on 11"×17" or A3 size paper, black and white transparency copies, and color copies. When a particular job is requested, if the temperature of the fuser roll or pressure roll is below a minimum temperature required by the corresponding performance level, the system manager either prevents operation or reduces the copy rate until the minimum temperature requirements are met. The result is consistent fuser performance of high quality copy output.

20 Claims, 5 Drawing Sheets

| STEP | OPERATION |
|---|---|
| 100 | START |
| 101 | WARM-UP |
| 102 | HAS PERFORMANCE LEVEL 1 BEEN REACHED WITHIN 345 SEC.? |
| 102A | DISPLAY FUSER SENSOR FAULT AND GOTO 306 |
| 103 | DISPLAY "PLEASE WAIT" UNTIL PERFORMANCE LEVEL 6 |
| 104 | DISPLAY "READY" |
| 200 | USER INPUT JOB PARAMETERS |
| 300 | START BUTTON DEPRESSED |
| 301 | CHECK JOB PARAMETERS |
| 302 | DETERMINE PERFORMANCE LEVEL |
| 303 | ARE FUSER ROLL AND/OR PRESSURE ROLL TEMP. ADEQUATE? |
| 303A | REDUCE COPY RATE OR CYCLE OUT AND REWARM AND DISPLAY "PLEASE WAIT" |
| 304 | MAKE ONE COPY |
| 305 | MORE COPIES THIS JOB? |
| 305A | GOTO 303 |
| 306 | END |

FIG. 5

FUSER TEMPERATURE AND COPY OUTPUT CONTROLLER

BACKGROUND OF THE INVENTION

1. Field of the Invention

The present invention relates to a fuser temperature and copy output controller in an electrophotographic copying machine, and more specifically, to a device and method for controlling copy output of an electrophotographic copying machine based on performance levels having minimum requirements depending on the job parameters of a job to be performed to increase output quality for regular and extended jobs.

2. Description of the Related Art k member is charged to a substantially uniform potential to sensitize the surface thereof. The charged portion of the photoconductive member is exposed. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a developed toner image on the photoconductive member which is subsequently transferred to a copy sheet. The copy sheet is heated by a fuser roll to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for differently colored images and their respective complimentarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid material or a powder material.

The temperature of the fuser roll is essential to high quality copy output. If the temperature is too high, the base material may be scorched. If the temperature is not high enough, the toner will not completely fuse to the base material resulting in smudging and runoff. In general, to maintain adequate fuser temperature, a substantial portion of the power inputted into the copy machine is directed to the fuser. Extended use of the copy machine causes the fuser temperature to dissipate, with insufficient power to continuously heat the fuser. As a result, copy quality gradually decreases during an extended copy job.

The temperature of the fuser is even more important in a color copy machine as the acceptable temperature range narrows. Multiple copies cause the fuser temperature to drop resulting in poor copy quality. Color copying using a transparent base material requires consistent quality or the resulting transparency for projection is blurry and unreadable.

SUMMARY OF THE INVENTION

Accordingly, it is an object of the present invention to provide a fuser temperature and copy output controller in an electrophotographic copying machine which overcomes the above-described problems in the prior art.

It is another object of the present invention to provide a fuser temperature and copy output controller and methods which achieve fuser temperature requirements while meeting fuser power allocation goals.

It is yet another object of the present invention to provide a fuser temperature and copy output controller and methods for a multi-color electrophotographic copying machine which achieve fuser temperature requirements based on base material type (i.e., paper or transparency) and size while meeting fuser power allocation goals.

These and other objects of the invention are attained by a fuser temperature and copy output controller having a control circuit which closely monitors the temperature of the fuser roll and the pressure roll. A plurality of performance levels have respective temperature level requirements for the fuser roll and pressure roll corresponding to the job parameters of a job to be performed. Upon detection of an unacceptable temperature level for particular job parameters, the control circuit either automatically reduces the copy travel rate, thereby supplying additional power to the fuser to elevate its temperature, or indicates "Please Wait" to the operator and rewarms the fuser. The result is superior copy quality regardless of the size of the job, loose material type, or base material size.

BRIEF DESCRIPTION OF THE DRAWINGS

Other objects and advantages will become apparent through the following detailed description of preferred embodiments taken in connection with the accompanying drawings in which:

FIG.5 is a table showing the steps of the flow chart of FIG. 4.

DETAILED DESCRIPTION OF A PREFERRED EMBODIMENT

Figure 1:
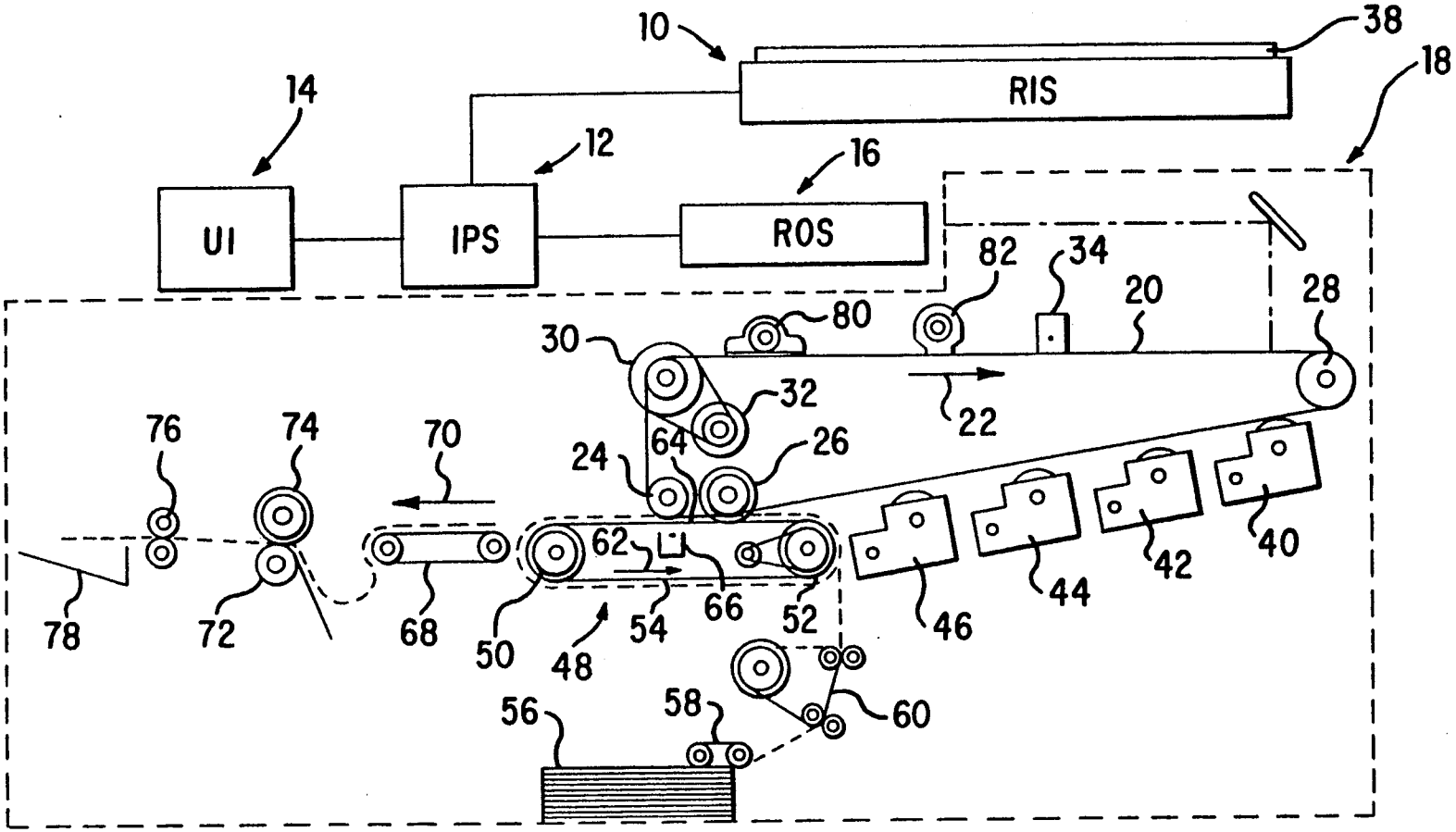
FIG. 1 is a schematic elevational view illustrating an electronic reprographic printing system incorporating the features of the present invention therein.

For a general understanding of the features of the present invention, reference is made to the drawings. In the drawings, like references have been used throughout to designated identical elements. FIG. 1 is a schematic elevational view of an illustrative electronic reprographic system incorporating the features of the present invention therein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 is the control electronics which prepare and manage the image data flow to the raster output scanner (ROS), indicated generally by the reference numeral 16. A user interface (UI), indicated generally by the reference numeral 14, is in communication with the IPS. The UI enables the operator to control the various operator adjustable functions. The output signal from the UI is transmitted from IPS 12. The signal corresponding to the desired image is transmitted from IPS 12 to ROS 16, which creates the output copy image. ROS 16 lays out the image in a series of horizontal scan lines with each line having a specified number of pixels per inch. The ROS includes a laser having a rotating polygon mirror block associated therewith. The ROS exposes the charged photoconductive surface of the printer, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. The electrophotographic printing machine employs a photoconductive belt 20. Preferably, the photoconductive belt 20 is made from a polychromatic photoconductive material. Belt 20 moves in the direction of arrow 22 to advance successive portions of the photoconductive surface sequentially through the various processing stations disposed about the path of movement thereof. Belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through the charging station. At the charging station, a corona generating device indicated generally by the reference numeral 34 charges photoconductive belt 20 to a relatively high, substantially uniform potential.

Next, the charged photoconductive surface is rotated to the exposure station. The exposure station includes the RIS 10 having a multi-colored original document 38 positioned thereat. The RIS captures the entire image from the original document 38 and converts it to a series of raster scan lines which are transmitted as electrical signals to IPS 12. The electrical signals from the RIS correspond to the red, green and blue densities at each point in the document. The IPS converts the set of red, green and blue density signals, i.e., the set of signals corresponding to the primary color densities of original document 38, to a set of colorimetric coordinates. The operator actuates the appropriate keys of the UI 14 to adjust the parameters of the copy. UI 14 may be a touch screen or any other suitable control panel, providing an operator interface with the system. The output signals from the UI are transmitted to the IPS. The IPS then transmits signals corresponding to the desired image to ROS 16. ROS 16 includes a laser with rotating polygon mirror blocks. Preferably, a nine facet polygon is used. The ROS illuminates the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material with the third latent being developed with yellow developer material. The latent images formed by the ROS on the photoconductive belt correspond to the signals from IPS 12.

After the electrostatic latent image has been recorded on photoconductive belt 20, belt 20 advances the electrostatic latent image to the development station. The development station includes four individual developer units generally indicated by the reference numerals 40, 42, 44 and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 40, 42 and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 10, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent imaged from a black and white original document. Each of the developer units is moved into and out of the operative position. In the operative position, the magnetic brush is closely adjacent the photoconductive belt, while, in the non-operative position, the magnetic brush is spaced therefrom. During development of each electrostatic latent image only one developer unit is in the operative position, the remaining developer units are in the non-operative position. This insures that each electrostatic latent image is developed with toner particles of the appropriate color with co-mingling. In FIG. 1, developer unit 40 is shown in the operative position with developer units 42, 44 and 46 being in the non-operative position.

After development, the toner image is moved to the transfer station where the toner image is transferred to a sheet of support material, such as plain paper amongst others. At the transfer station, the sheet transport apparatus, indicated generally by the reference numeral 48, moves the sheet into contact with photoconductive belt 20. Sheet transport 48 has a pair of spaced belts 54 entrained about rolls 50 and 52. A gripper extends between belt 54 and moves in unison therewith. The sheet is advanced from a stack of sheets 56 disposed on a tray. A friction retard feeder 58 advances the uppermost sheet from stack 56 onto a pre-transfer transport 60. Transport 60 advances the sheet to sheet transport 48. The sheet is advanced by transport 60 in synchronism with the movement of the gripper, in this way, the leading edge of the sheet arrives at a preselected position, i.e., a loading zone, to be received by the open gripper. The gripper then closes securing the sheet thereto for movement therewith in a recirculating path. The leading edge of the sheet is secured releasably by the gripper. As the belts move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper magnitude and polarity for attracting the toner image from photoconductive belt 20 thereto. The sheet remains secured to the gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner which are transferred, in superimposed registration with one another, to the sheet to form the multi-color copy of the colored original document.

After the last transfer operation, the grippers open and release the sheet. Conveyor 68 transports the sheet, in the direction of arrow 70, to the fusing station where the transferred image is permanently fused to the sheet. The fusing station includes a heated fuser roll 74 and a pressure roll 72. The sheet 52 passes through the nip defined by fuser roll 74 and pressure roll 72. The toner image contacts fuser roll 74 so as to be affixed to the sheet. Thereafter, the sheet is advanced by forwarding roll pairs 76 to catch tray 78 for subsequent removal therefrom by the machine operator.

The last processing station in the direction of movement of belt 20, as indicated by arrow 22, is the cleaning station. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
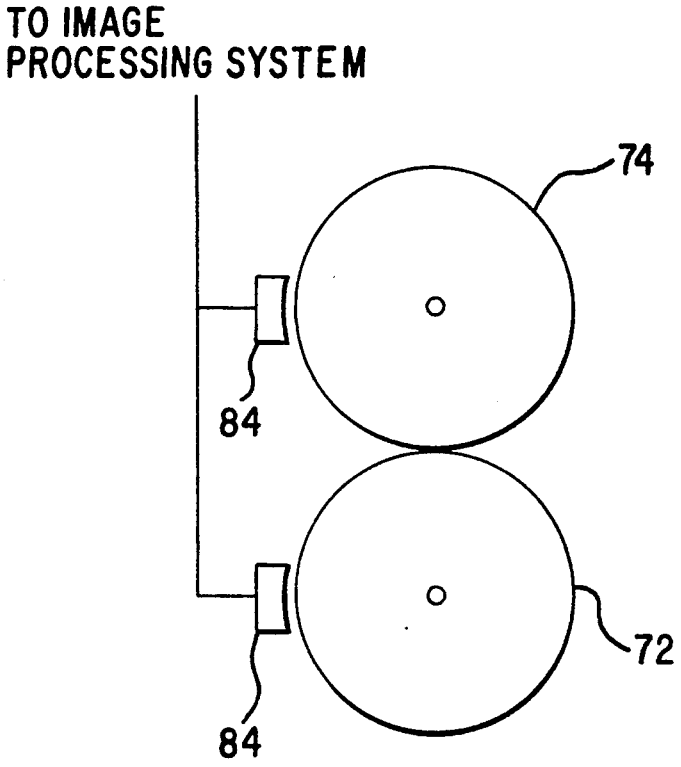
FIG. 2 is a front view of a fuser roll and a pressure roll of the present invention.

Referring now to FIG. 2, temperature sensing of both fuser roll 74 and pressure roll 72 is achieved by a contact thermistor 84 located on each roll. Each roll is heated by a quartz halogen lamp (not shown), controlled by separate solid state relays (SSR) from information received by the thermistors and processed by IPS 12.

The temperature control values may be addressed through the nonvolatile memory (NVM), for service adjustment, by approximately +/−15° F. (NVM range of 105 to 136 units) to enable temperature compensation for special performance level requirements. These values are read out in °F. or °C. depending upon the product.

Copy quality is measured based on specific output characteristics. These characteristics include transparency projection efficiency (TPE), gloss, and fuse fix. Transparency projection efficiency (TPE) relates to the clarity of a photocopy on a transparent base material. As described above, the use of a transparent base material, especially for multicolor applications, creates the need for more precise fuser roll temperature requirements. Gloss relates to the glossy finish of the image output on the base material. The gloss characteristic is directly related to the fuser temperature (i.e., the better the fuse, the better the gloss). Lastly, fuse fix relates to the fix of the toner to the base material. As discussed above, if the temperature of the fuser is low, the toner will not completely adhere to the base material, resulting in smudging and runoff. The fuse fix characteristic is measured using a method in which the base material is scratched after photocopying.

To achieve satisfactory product characteristics (TPE, gloss, fuse fix) thereby achieving high quality output, several operating states are monitored during the copy mode, depending upon the parameters of the job selected (color, transparencies, black & white, paper size). If the selected job requires a fuser temperature above the detected fuser temperature, the machine will either:

a. cycle out and inform the operator to "Please Wait: The System is Warming Up." Upon reaching the fusing temperature conditions required by the job selected, the machine will inform the operator that the machine is "Ready", at which point the operator selects start to continue the job; or b. reduce the copy rate from 20 to 10 copies per minute (cpm). Generally, the copy rate is only reduced when paper size is 11"×17" or A3, however, reducing the copy rate would achieve the desired output for the other jobs as well.

There are three basic modes of operation that occur which require temperature control: warm up, standby, and run.

The following is a description of the types of operations that occur during each of the above modes. In the warm up mode, the temperature of fuser roll 74 and pressure roll 72 is sampled on alternating half second intervals. To determine if the temperature readings taken are valid, previous readings are compared to current readings, and validity is determined. Also, the determination of the lamp status is updated each second. The time, from power up, for the fuser roll to reach the warm up temperature range is 5 minutes and 45 seconds, or 345 seconds. If the fuser roll has not reached the desired temperature within that time frame, a fuser sensor fault is displayed. When the fuser roll has reached the desired temperature, a status update is sent to IPS 12.

In the standby mode, the fuser roll temperature and the pressure roll temperature are controlled independently. The fuser roll temperature is preferably in the range of 380° F. to 390° F., and preferably about 385° F. The pressure roll temperature is preferably about 350° F.

In the run mode, fuser roll 74 is dominant over pressure roll 72, i.e., if the fuser roll requires power, the pressure roll lamp is turned off. Temperature status updates of the pressure roll and the fuser roll are sent to IPS 12. The fuser roll temperature during the run mode is maintained at about 385° F. At no time during the run mode are both the fuser roll and the pressure roll lamps "on" due to the total fuser power allocation goals.

Figure 3:
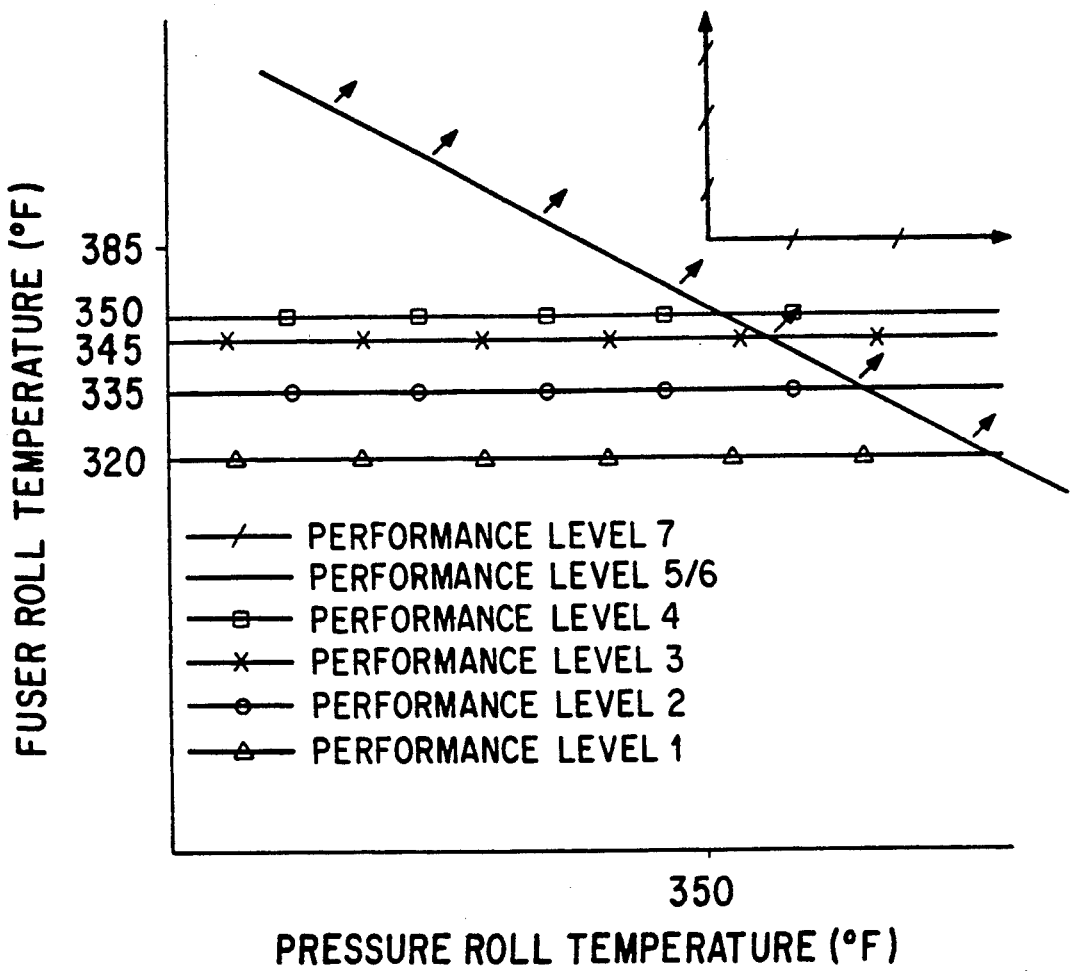
FIG. 3 is a graph illustrating the performance level temperature requirements.

The fuser operation is broken down into seven states, called performance levels corresponding to fuser copy quality characteristics, i.e. TPE, gloss and fuse fix. Each level contains minimum parameters for various job parameters. For example, referring to FIG. 3 and Table 1, performance level 1 corresponds to a warm-up state. If the fuser roll has not reached a predetermined temperature (i.e., that defined by performance level 1) within a predetermined time, a fuser roll undertemp fault is displayed. Performance level 2 corresponds to the minimum performance level for black and white paper copies. The minimum fuser roll temperature is 335° F. Performance level 3 corresponds to the minimum level for black and white paper copies using A3 or 11"×17" size paper. The minimum fuser roll temperature at performance level 3 is 345° F. Performance level 4 corresponds to the minimum level for black and white transparencies. The minimum fuser roll temperature is 350° F. Performance levels 5 and 6 correspond to the minimum levels for high quality transparency projection efficiency and gloss characteristics for color copies. For these job parameters, the temperature of fuser roll 74 and pressure roll 72 must satisfy the following relation:

(1) $T(F/R)+0.46[T(P/R)] \geqq 522°$ F., where T(F/R) is the temperature of the fuser roll and T(P/R) is the temperature of the pressure roll.

At performance level 7, all jobs are available. The minimum fuser roll temperature is about 385° F., and the minimum pressure roll temperature is about 350° F.

TABLE I

| PERFORMANCE LEVEL | JOB REQUIREMENT | MIN F/R TEMP °F. | MIN P/R TEMP °F. | MACHINE STATUS IF BELOW REQUIRED TEMP |
|---|---|---|---|---|
| 1 | FUSER NOT READY TO MAKE COPIES | 320 | N/A | UNDERTEMP FAULT |
| 2 | MIN FUSE FIX BLACK COPY MODE | 335 | N/A | CYCLE OUT, PLEASE WAIT |
| 3 | MIN FUSE FIX FOR A3 OR 11 × 17 JOB, B/W JOB | 345 | N/A | SHIFT CPM FROM 20 TO 10 |
| 4 | MIN FUSE FIX FOR BLACK TRANSPARENCIES | 350 | N/A | CYCLE OUT, PLEASE WAIT |
| 5 & 6 | TPE AND GLOSS FOR COLORED COPIES | SEE EQUATION (1) | SEE EQUATION (1) | CYCLE OUT, PLEASE WAIT |
| 7 | ALL JOBS ARE AVAILABLE | 385 | 350 | |

Figure 4:
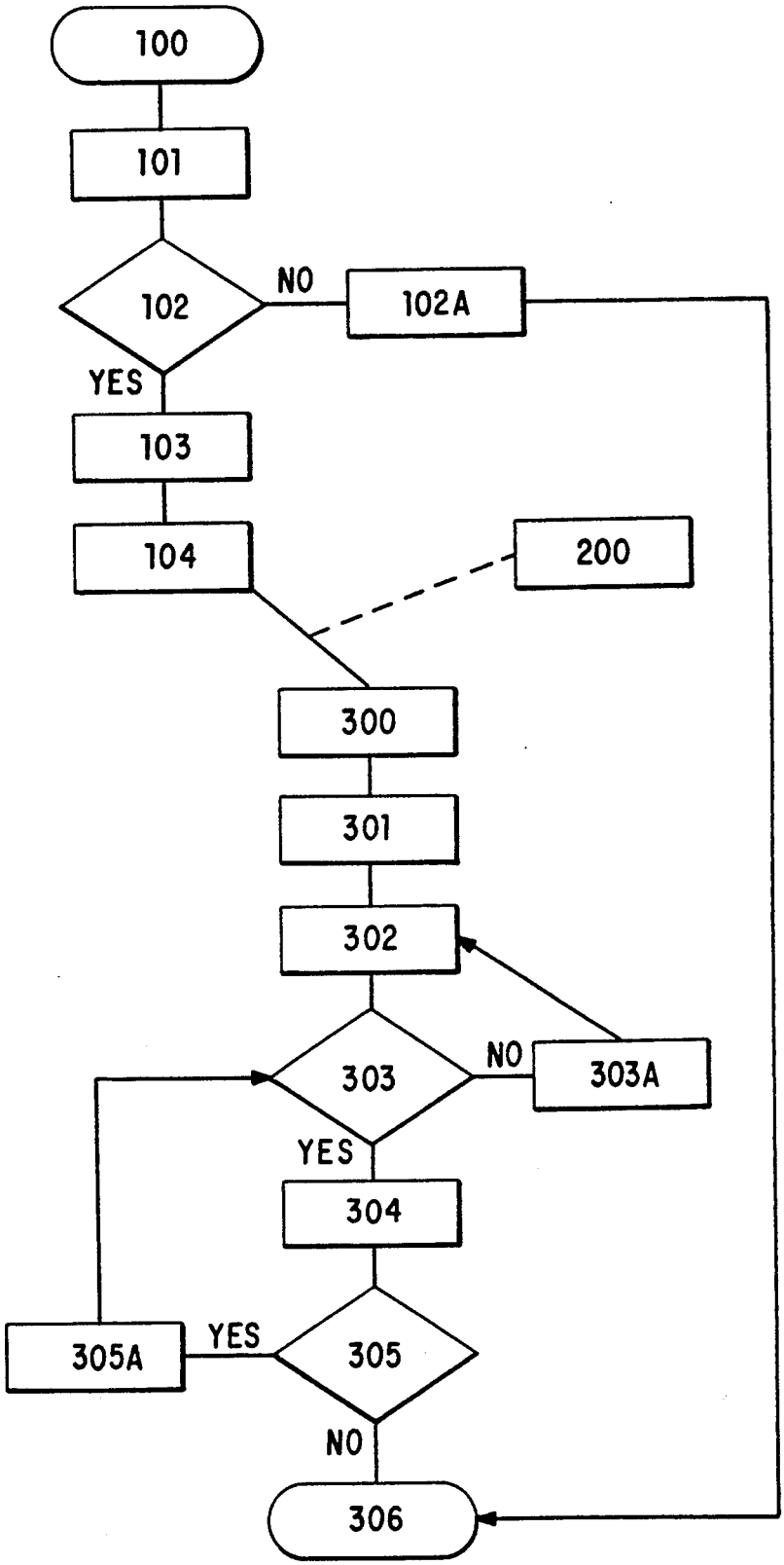
FIG. 4 is a flow chart of the operation of the present invention.

These performance levels are used to determine if the requested job will be performed with a satisfactory fuser roll temperature to satisfy quality requirements. Referring now to FIGS. 4 and 5, the operation steps will be described. The operation begins when the machine is turned on at step 100. Step 101 is the warm up stage where fuser roll 74 and pressure roll 72 are heated. Copying is not permitted during this stage. If after 5 minutes and 45 seconds, the fuser temperature has not reached performance level 1, a fuser sensor fault is displayed, step 102A and the operation is terminated. If step 102 is satisfied (i.e., performance level 1 is achieved within 345 seconds), fuser roll 74 and pressure roll 72 are heated until reaching performance level 6, step 103. Performance level 6 is required for the first warm up only. A "Please Wait" is displayed. Upon reaching level 6, a "Ready" is displayed in step 104. Except for the first warmup, "Ready" is displayed if the fuser temperature is warmer than performance level 4.

At step 200, the operator inputs the parameters for the job to be performed, including base material type, paper size, color copy, etc. When "Start" is depressed, step 300, IPS 12 then determines a performance level corresponding to the job parameters, step 302, and checks the fuser and pressure roll temperatures, step 303. If the temperatures are inadequate for the job parameters, IPS 12 either reduces the copy rate or cycles out and warms fuser roll 74 and pressure roll 72, step 303A. In this event, "Please Wait" is displayed until performance level 7 is achieved. If the temperatures satisfy step 303, the machine makes a single copy, step 304. In step 305, IPS 12 determines whether there are more copies to be made for this job. If so, step 305A returns to operation the step 303 to determine if the temperatures are still adequate. If the job is completed, the operation is ended in step 306.

The above-defined operation provides consistent copy quality regardless of the size of the job, the base material size or type, copy type, etc. Although the invention has been described in connection with a preferred embodiment thereof, it is not meant to be limited thereto. Those skilled in the art will be able to contemplate various alternatives within the scope of the invention, which is outlined in the following claims.

What is claimed is:

1. An electrophotographic copy machine having a fuser roll and a pressure roll, said electrophotographic copy machine comprising:

means for determining job parameters for a job to be performed;

means for monitoring temperature of said fuser roll and said pressure roll;

manager means for controlling operation of said copy machine based on said job parameters and the temperature of said fuser roll and said pressure roll;

means for defining a plurality of performance levels, each of said plurality of performance levels corresponding to said job parameters and having minimum temperature requirements for said fuser roll and said pressure roll; and means for determining a performance level from said plurality of performance levels, wherein said manager means continuously controls operation of said copy machine in accordance with said determined performance level.

2. An electrophotographic copy machine according to claim 1, wherein said manager means prevents operation of said copy machine if the temperature of said fuser roll or said pressure roll is below said minimum temperature requirement, thereby holding operation until said requirements are met.

3. An electrophotographic copy machine according to claim 1, wherein said manager means controls a copy rate of said copy machine, said manager means reducing said copy rate if the temperature of said fuser roll or said pressure roll is below said minimum requirements, thereby slowing operation until said requirements are met.

4. An electrophotographic copy machine according to claim 3, wherein said manager means comprises means for increasing power to at least one of said fuser roll and said pressure roll when said copy rate is reduced.

5. An electrophotographic copy machine according to claim 1, wherein said job parameters comprise black and white paper copy, black and white paper copy using 11"×17" or A3 size paper, black and white transparency copy, and color copy.

6. An electrophotographic copy machine according to claim 4, wherein said minimum temperature requirements for the performance level corresponding to said color copy job parameter are determined by an equation, said equation being:

$$T(F/R)+0.46[T(P/R)]\geqq 522^\circ F.,$$

wherein T(F/R) is the temperature of said fuser roll and T(P/R) is the temperature of said pressure roll.

7. An electrophotographic copy machine having a fuser roll, said electrophotographic copy machine comprising:

means for determining job parameters for a job to be performed;

means for defining a plurality of performance levels, each of said plurality of performance levels corresponding to said job parameters and having minimum temperature requirements for said fuser roll;

means for determining a performance level from said plurality of performance levels in accordance with said job parameters;

means for monitoring temperature of said fuser roll; and means for continuously controlling operation of said copy machine if the temperature of said fuser roll is below said corresponding minimum temperature requirement of said determined performance level.

8. An electrophotographic copy machine according to claim 7, wherein said means for controlling operation of said copy machine includes means for preventing operation of said copy machine, thereby holding operation of said copy machine until said temperature requirement is met.

9. An electrophotographic copy machine according to claim 7, wherein said means for controlling operation of said copy machine includes means for reducing the copy rate of said copy machine, thereby slowing operation of said copy machine until said temperature requirement is met.

10. An electrophotographic copy machine according to claim 9, wherein said means for controlling comprises means for increasing power to said fuser roll when said copy rate is reduced.

11. A method of controlling operation of an electrophotographic copy machine having a fuser roll and a pressure roll, said method comprising the steps of:

determining job parameters of a job to be performed;

monitoring temperature of said fuser roll and said pressure roll;

controlling operation of said copy machine based on said job parameters and the temperature of said fuser roll and said pressure roll;

defining a plurality of performance levels, each of said plurality of performance levels corresponding to said job parameters and having minimum temperature requirements for said fuser roll and said pressure roll; and determining a performance level from said plurality of performance levels, wherein said controlling step is performed continuously in accordance with said determined performance level.

12. A method according to claim 11, wherein said controlling step comprises the step of preventing operation of said copy machine if the temperature of said fuser roll or said pressure roll is below said minimum temperature requirement, thereby holding operation until said requirements are met.

13. A method according to claim 11, wherein said controlling step comprises the step of controlling a copy rate of said copy machine, said controlling step further comprising the step of reducing said copy rate if the temperature of said fuser roll or said pressure roll is below said minimum requirements, thereby slowing operation until said requirements are met.

14. A method according to claim 13, further comprising the step of increasing power to at least one of said fuser roll and said pressure roll when said copy rate is reduced.

15. A method according to claim 11, wherein said job parameters comprise black and white paper copy, black and white paper copy using 11"×17" or A3 size paper, black and white transparency copy, and color copy.

16. A method according to claim 15, wherein said minimum temperature requirements for the performance level corresponding to said color copy job parameter are determined by an equation, said equation being:

$$T(F/R)+0.46[T(P/R)]\geqq 522^\circ F.,$$

wherein T(F/R) is the temperature of said fuser roll and T(P/R) is the temperature of said pressure roll.

17. A method of controlling operation of an electrophotographic copy machine having a fuser roll, said method comprising the steps of:

determining job parameters of a job to be performed;

defining a plurality of performance levels, each of said plurality of performance levels corresponding to said job parameters and having minimum temperature requirements for said fuser roll;

monitoring temperature of said fuser roll; and continuously controlling operation of said copy machine if the temperature of said fuser roll is below said corresponding minimum temperature requirement of said determined performance level.

18. A method according to claim 17, wherein said controlling step includes the step of preventing operation of said copy machine, thereby holding operation of said copy machine until said temperature requirement is met.

19. A method according to claim 17, wherein said controlling step includes the step of reducing the copy rate of said copy machine, thereby slowing operation of said copy machine until said temperature requirement is met.

20. A method according to claim 19, further comprising the step of increasing power to said fuser roll when said copy rate is reduced.

* * * * *